United States Patent [19]

Edwards et al.

[11] 3,942,648

[45] Mar. 9, 1976

[54] MODEL RAILWAY SYSTEM PROVIDING UNCOUPLING AND DELAYED RECOUPLING

[76] Inventors: Clarence K. Edwards, 1017 Black Oak Drive; Lawrence D. Edwards, 2816 Rosemont Ave., both of Medford, Oreg. 97501

[22] Filed: May 9, 1975

[21] Appl. No.: 576,098

[52] U.S. Cl. ..... 213/75 TC; 46/216; 213/75 D; 213/212

[51] Int. Cl.[2] ..... B61G 7/04

[58] Field of Search ..... 213/75 TC, 75 D, 211, 212; 46/216–218

[56] References Cited

UNITED STATES PATENTS

| | | | |
|---|---|---|---|
| 3,069,023 | 12/1962 | Ross | 213/211 |
| 3,111,229 | 11/1963 | Edwards et al. | 213/212 |
| 3,659,725 | 5/1972 | Passalacqua | 213/75 D X |
| 3,840,127 | 10/1974 | Edwards et al. | 213/75 D X |

*Primary Examiner*—Drayton E. Hoffman
*Assistant Examiner*—John P. Shannon
*Attorney, Agent, or Firm*—Clarence M. Crews

[57] ABSTRACT

This invention relates to a model railway system employing a novel uncoupling mechanism for couplers of the type which are coupled by having one coupler cam another upward so that it may then drop into the coupled relationship. Couplers of this type, equipped with suitable magnets, can be uncoupled mechanically or by magnetic repulsion or attraction. In accordance with the present invention a normally inactive uncoupling magnet, located at an uncoupling station, is rendered active, thereby to effect uncoupling by magnetic repulsion of one of the couplers. The couplers, after being thus disconnected, are displaced laterally in opposite directions by magnetic attraction and the raised coupler is then permitted to drop. The altered relationship is such that one coupler may push the other without recoupling. By this means a detached car or train section can be pushed to any desired location and left there. When this has been done the locomotive-connected train section may be withdrawn to permit the couplers, under spring action, to resume their normal positions. They will then automatically recouple when thrust together.

8 Claims, 13 Drawing Figures

MODEL RAILWAY SYSTEM PROVIDING UNCOUPLING AND DELAYED RECOUPLING

This invention relates to a novel model railway system capable of effecting magnetic uncoupling and delayed recoupling of cars which can only be mechanically coupled by causing one coupler to be raised relative to another and then to drop into coupled relationship.

The purpose of the present invention is to provide means whereby one of two connected couplers of the kind referred to may be lifted to an uncoupled position by magnetic repulsion at an uncoupling station. Both couplers will then be deflected laterally by magnetic attraction, and the raised coupler can then be lowered by gravity into a non-coupling relationship to the other, so one car can push the other through the couplers to a desired parking location and leave it there. Having done this the couplers will automatically, upon separation of the cars, resume their normal positions so that automatic recoupling of the parked car and the driven car will result upon the bringing of the couplers together again.

In the drawings forming part of this specification,

FIG. 1 is a fragmentary plan view of adjacent ends of two separated cars at opposite ends of a magnetic uncoupling station, the cars being equipped with identical, cooperative couplers which are generally of the type hereinbefore referred to;

Figure 10:
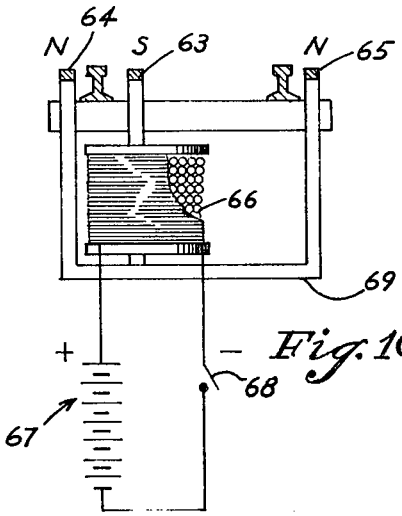
FIG. 10 is a view in elevation, partly in section, showing a modified form of magnetic uncoupler means for accomplishing essentially the same result as the embodiment of FIGS. 1 to 9.
Figure 11:
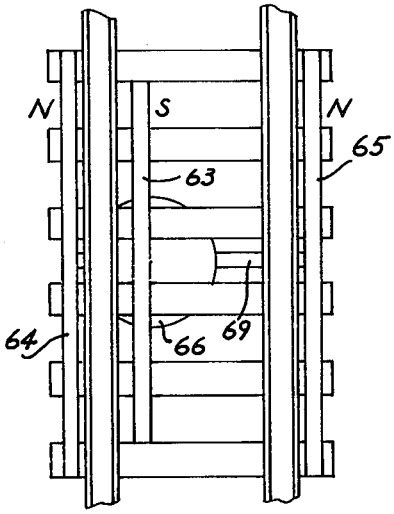
FIG. 11 is a plan view of the modified form shown in FIG. 10.
Figure 12:
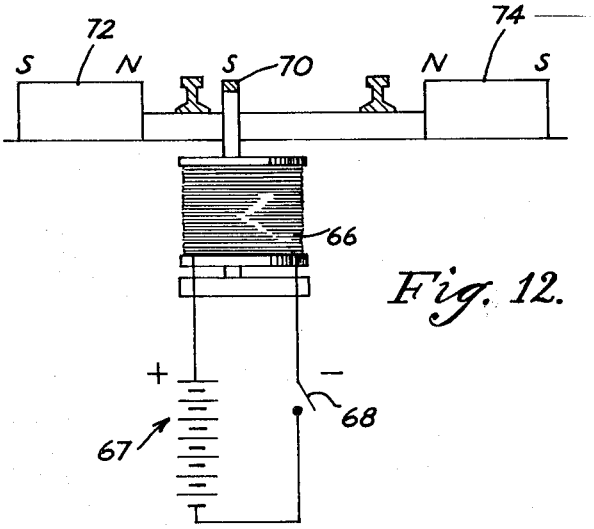
Figure 13:
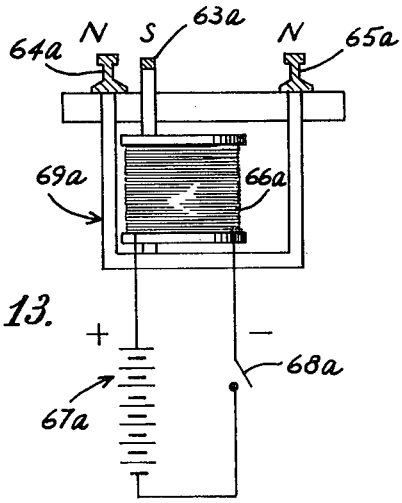

FIG. 12 is a plan view of a still further modified form in which the central repelling magnet is of the switch controlled electromagnetic type, and the side magnets are of the permanent type; and FIG. 13 is a transverse sectional view in elevation of a structure generally like that of FIGS. 10 and 11, but in which track sections of magnetic material at the uncoupling station serve as the side magnetic poles for attracting the active poles of the coupler carried permanent magnets.

As shown in FIGS. 1 to 7, the track 10, consisting of crossties 12 and rails 14, is mounted on a suitable support such as a board 16, which is formed with a rectangular recess 18 of suitable depth at an uncoupling station. At the uncoupling station, the crossties are cut away between the rails to provide clearance for a permanent magnet 20 which has north and south poles as indicated by the legends N and S in FIG. 1, which poles extend for the entire length of the magnet.

The magnet is affixed to a carrying plate 22. The carrying plate 22 has unitary with it a stem 24 which is guided in a fixed sleeve 26. The plate 22 also includes guide pins 28 which extend through a fixed guide plate 30. The guide plate 30 is affixed to the upper end of the sleeve 26. A spring 32 surrounds the stem 24, bearing at its upper end against the lower end of fixed sleeve 26 and at its lower end against a crosspin 34 which is fixed in the lower end of stem 24. The spring 32 assists gravity in normally maintaining the magnet 20 in the lower, inactive position illustrated in FIG. 2, so that car couplers can normally pass through the uncoupling stations without being affected by the magnet 20.

Figure 3:
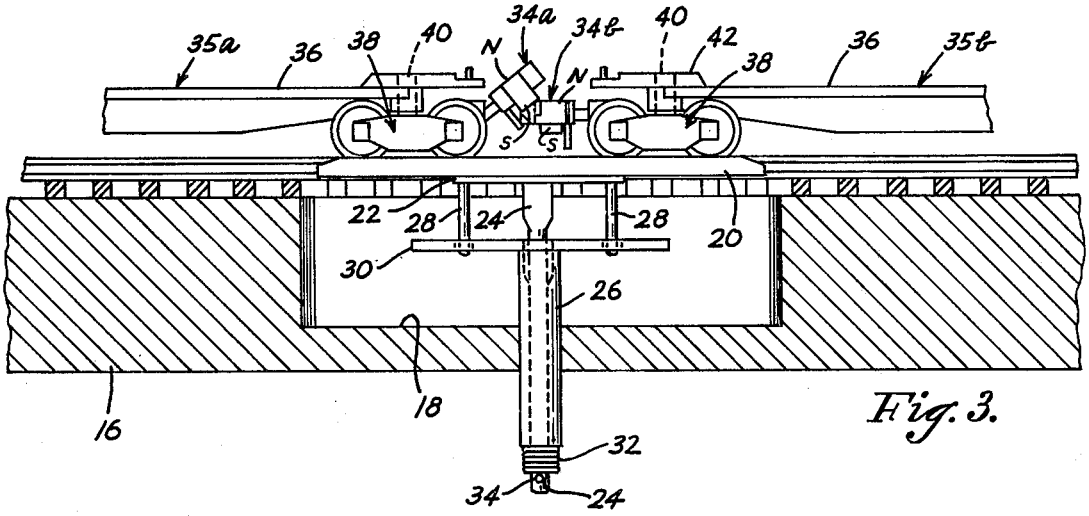
FIG. 3 is a view similar to FIG. 2, but showing the uncoupling magnet effective and the cars uncoupled.
Figure 4:
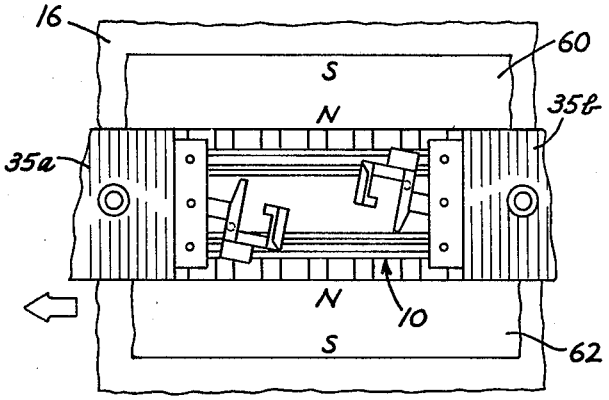
FIG. 4 is a fragmentary plan view showing the uncoupled car ends separated but still in the uncoupling station, after the adjacent couplers have been swung away from one another by fixed magnets and the center magnet has been rendered ineffective.

When uncoupling is desired, however, the stem 24 may be thrust upward to move the magnet 20 upward to the active position, approximately at rail top level, illustrated in FIG. 3. The upward thrust may be imparted to the stem manually or from a remote control station through any suitable means (not shown). Such upward movement of the magnet 20 and its operating stem 24 involves compression of the spring 32 so that the magnet 20 is promptly and definitely returned to the position of FIG. 2 by the spring and gravity as soon as the upward thrust applied to stem 24 is withdrawn.

Figure 8:
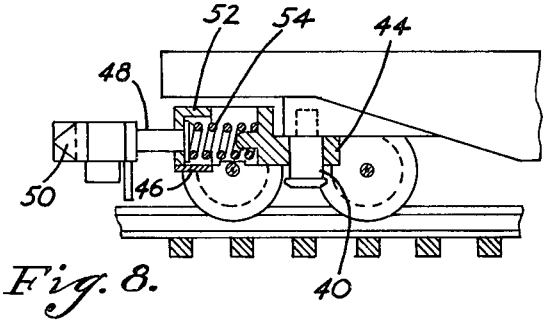
FIG. 8 is a fragmentary parti-sectional view of one of the couplers and the mounting means therefor.

The generally C-shaped couplers 34*a* and 34*b* at the ends of adjacent cars 35*a* and 35*b* may be constructed and mounted as illustrated in FIG. 8 with freedom for tilting upward or sidewise. They are, however, incapable of being coupled or uncoupled through lateral movement as clearly shown in FIG. 5.

The car bodies 36 are mounted on wheel and axle assemblies 38 (FIGS. 2, 3 and 8), each of which is pivotally attached to the car body by a pivot pin 40, press-fitted into frame portion 42 of the car body.

Each such truck assembly also carries a coupler mechanism which includes a spring housing 44. The bottom of the spring housing is closed by a separable plate 46. The coupler 48 has a collar 52 secured to its inner end and the coupler is yieldingly thrust outward by a spring 54.

Coupler bar 48 is provided with an outwardly directed knife-edged hook portion 50 and a stop flange or collar 52 at the opposite end to limit outward movement of the coupler bar under the action of a compression coil spring 54. The coupler head can be deflected upwardly or laterally. Cooperative couplers cannot be engaged or disengaged accidentally, however, through lateral rocking of couplers, the gap in the side of each coupler being too narrow to pass the hook portion of the other.

Each coupler hook has affixed to it, at its outer side, a small permanent magnet 56, the south pole 58 of which is at the lower end and normally extends down beyond the lower extremity of the coupler by which it is carried.

When the magnet 20 is in raised (active) position, the south pole of one of the couplers travels directly over the south pole of the magnet 20 and is raised by magnetic repulsion, while the south pole of the other coupler travels over the north pole of magnet 20 and is drawn downward by magnet 20. The couplers are thus moved clear of one another, so that they are free to be swung laterally by magnetic attraction of the side magnets. The relative lengths of the central magnet and of the side magnets is unimportant, since the central magnet 20 can be dropped to its ineffective condition while disengagement and lateral shifting of the couplers is maintained.

Side permanent magnets 60 and 62, shown as coterminous in length with the magnet 20, are affixed at substantially rail top level to supporting member 16 at opposite sides of the track and near to it. These magnets, like the magnet 20, have elongated north and south poles, the north pole, in each instance, being the pole nearer to the track and therefore adapted to attract the adjacent, downwardly extending south pole 58 of the nearer coupler carried magnet 56.

As soon as the condition illustrated in FIG. 3 is attained, the locomotive-connected car is moved to separate the cars slightly, and the magnet 20 is then permitted to drop to its normal, ineffective position. The south pole of the magnet 56 carried by coupler 34b will be swung toward the magnet 60 and the condition of FIG. 4 will result. Each coupler will now have been drawn by the south pole of the magnet carried by it toward the north pole of the adjacent, fixed magnet 60 or 62 as the case may be.

Figure 5:
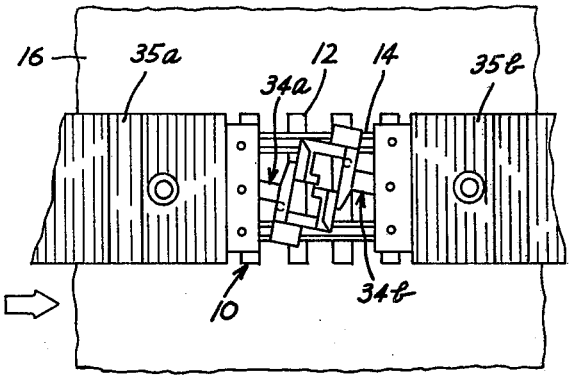
FIG. 5 is a view similar to FIG. 4 showing the uncoupled and laterally skewed couplers brought together in a relationship suitable for pushing one coupler by the other without recoupling, to any location desired.

If, now, the locomotive-connected car is pushed toward the idle, disconnected car, a condition like that illustrated in FIG. 5 will result. In FIG. 5 the locomotive-connected car has pushed the detached car to any location desired on a siding or on the main track away from the uncoupling station, and is about to be withdrawn for leaving the detached car there.

Figure 1:
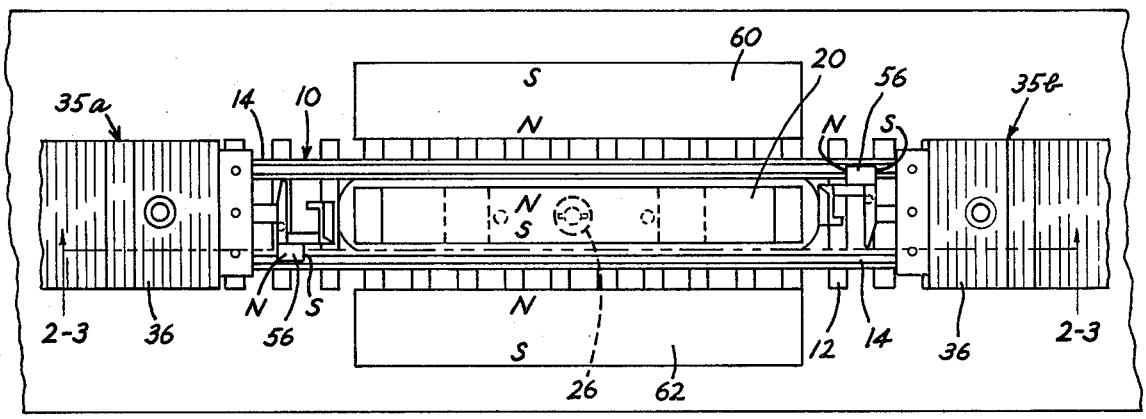
Figure 2:
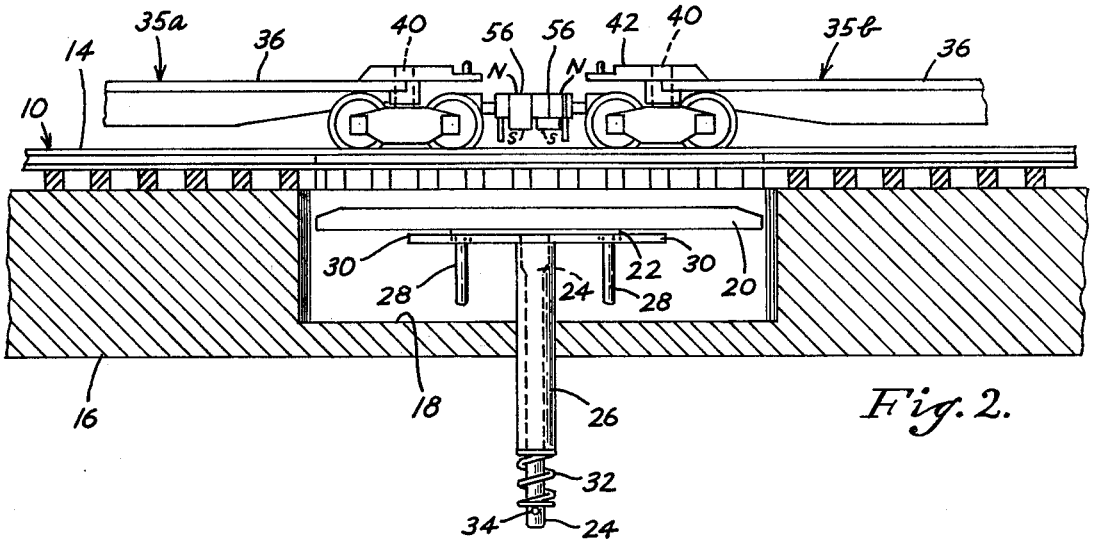
FIG. 2 is a fragmentary sectional view in side elevation showing the cars joined to one another in a suitable position for uncoupling.
Figure 6:
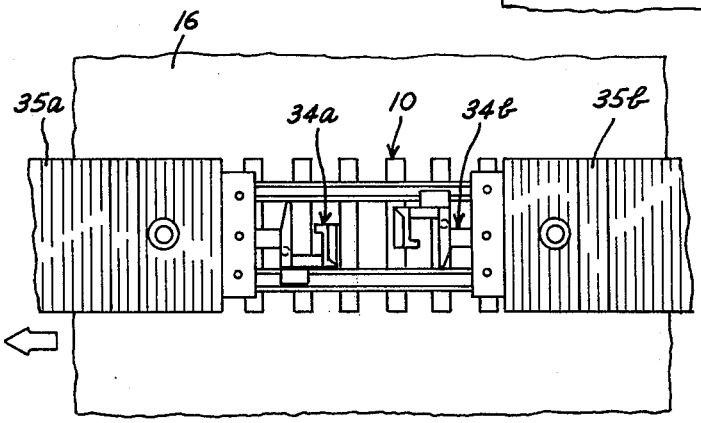
FIG. 6 is a view like FIG. 5 but showing the locomotive-connected car about to be recoupled to the parked car.
Figure 7:
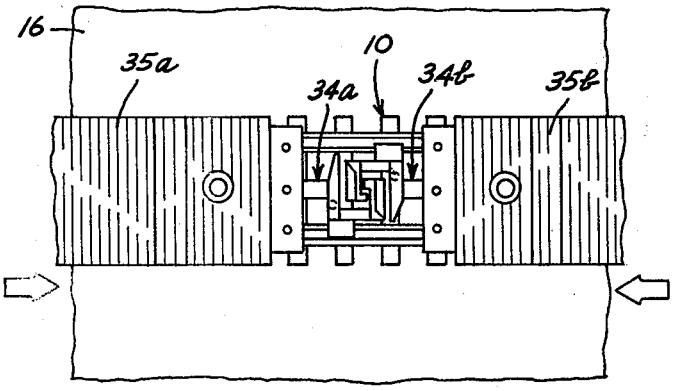
FIG. 7 shows the cars recoupled.
Figure 9:
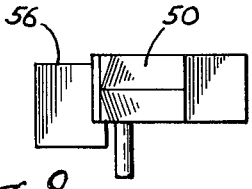
FIG. 9 is a view in front elevation, partly diagrammatic, of a coupler and the magnet carried by it.

As soon as such withdrawal occurs the couplers, being removed from the uncoupling station and from engagement with one another, will resume their normal conditions, as illustrated in FIG. 6 and in FIG. 1. They are now in condition to be recoupled at the location at which the detached car was left. When subsequently brought together in that location, one of the couplers will be cammed upward by the other and will then drop into the normal, coupled relationship illustrated in FIG. 7.

An alternative structure is disclosed in FIGS. 10 and 11 for achieving essentially the same result.

Instead of employing permanent magnets at the uncoupling station for lifting one coupler and then swinging both couplers laterally, electromagnets are employed for first lifting one coupler by magnetic repulsion, then swinging both couplers laterally in opposite directions by magnetic attraction of side magnets, and then, while keeping the couplers in their laterally swung positions permitting the raised coupler to drop into position to push the other coupler without recoupling.

In the embodiment of FIGS. 10 and 11, the cars, including the couplers and the coupler magnets, are the same as before. An elongated, normally inert electromagnetic pole 63 is provided in fixed position at rail top level directly below the path of one of the coupler carried permanent magnets, such pole, when energized, being effective to lift one of the couplers through electromagnetic repulsion.

Normally ineffective side magnetic poles 64 and 65 at the uncoupling station, adapted to be energized simultaneously with the coupler lifting electromagnetic pole 63, but of the opposite sign, draw both couplers laterally as soon as the couplers are freed from their interlocking relationship by the lifting of one of them. All three poles 63, 64 and 65 are energized through a coil 66, from a battery 67 or other suitable means.

The side poles 64 and 65 and the lifting pole 63 are controlled simultaneously through a common switch 68. The three poles are unitary with one another and the single energizing coil 66, rendered active by the manual closing of the switch 68, is wrapped around a central arm of a three-armed magnet energizer 69. The closing of the switch causes one coupler to be raised by magnetic repulsion, and both couplers when so freed from their interlocking relationship to be swung laterally by magnetic attraction of the respective side electromagnetic poles 64 and 65.

The side poles 64 and 65 are of the same sign, appropriate to attract the coupler carried magnets, while the central pole 63 is of the opposite sign, appropriate to repel upward the coupler carried magnet beneath which it is located.

The side poles 64 and 65 are desirably made to extend beyond the ends of the central pole 63 as shown in FIG. 11, so that the lateral displacement of the couplers will be maintained until after the raised coupler has been permitted to drop into the pushing relationship.

A third embodiment of the invention is illustrated in FIG. 12. Here the lifting magnetic pole 70 is an electromagnetic pole while the side magnets 72 and 74 are permanent magnets. The permanent magnets, though active, cannot pull the couplers apart so long as they are interlocked, though they do seek to do so when the couplers are situated in the uncoupling station.

Even a momentary energization of the uncoupling electromagnetic pole 70 will raise one of the couplers through electromagnetic repulsion, permitting the couplers to be swung laterally by the permanent side magnets 72 and 74, and to be retained in the laterally swung relationship after the central electromagnet has been deenergized. Deenergization of the central electromagnet, therefore, even after it has been energized only momentarily, will bring about the relationship in which one coupler can push the other without recoupling, so that delayed recoupling can be realized.

It should be understood, of course, that where reference is made to north poles and south poles of magnets, specific illustrative structures are being described. A complete reversal of polarities throughout would be equally operative.

A still further embodiment is illustrated in FIG. 13. As before, the cars and the couplers carried by them, including the coupler carried permanent magnets, are as already described.

Ordinarily the track rails 14 are of brass, but in this instance short track rails of steel constitute terminal portions of electromagnetic pole members for drawing the coupler carried magnets sidewise after one of the couplers has been raised to an uncoupled position through magnetic repulsion. The magnetizable track sections of FIG. 13 extend at both ends beyond the coupler repelling electromagnetic pole.

There is no reason why the track rail of the entire system cannot be composed of magnetic material, since current is supplied to the uncoupling electromagnet from a source distinct from that which drives the locomotive. The same reference numerals used in FIGS. 10 and 11 have, therefore, been applied to corresponding parts in FIG. 13 with the postscript *a* added in each instance and no further description will be given.

We have described what we believe to be the best embodiment of our invention. What we desire to cover by letters patent, however, is set forth in the appended claims.

We claim:

1. A model railway system having track rails for rolling stock, which system provides for uncoupling, and for delayed recoupling, of the supported cars, said cars being equipped with couplers of the kind in which a coupler can normally be rocked upward for automatic coupling and for uncoupling, and when so rocked for uncoupling both couplers can then be rocked laterally and then allowed to assume an abnormal relationship in which one car can push another through the laterally rocked couplers without recoupling, said system comprising a. coupler carried magnets affixed to the respective couplers of a pair of coupled cars, said magnets having lower poles of the same polarity, which poles are disposed to travel in distinct, substantially separated paths, parallel to the track rails and to one another, b. an uncoupling station in the trackway which includes a normally ineffective coupler lifting magnet, which magnet is so located that, when rendered effective, it lifts a single coupler to an uncoupled position by magnetic repulsion, said coupler lifting magnet having an elongated pole of the same polarity as the lower poles of the coupler carried magnets, and c. additional, side magnetic means at the uncoupling station at opposite sides of the coupler carried magnets, and each having active poles of opposite sign to the lower poles of the coupler carried magnets for deflecting the respective couplers laterally by magnetic attraction to a relationship in which the coupler of a locomotive-connected car can push the other coupler and the car on which said other coupler is carried, without recoupling, to any desired parking position, and can then leave it there while being individually withdrawn.

2. A model railway system as set forth in claim 1 in which springs are provided for automatically restraightening deflected couplers to their normal conditions upon car separation in a location removed from the uncoupling station, thereby adapting the couplers for automatic recoupling, when separation of uncoupled cars is effected.

3. A model railway system as set forth in claim 1 in which the couplers are C-shaped in form, the openings of the C's being too narrow to permit lateral recoupling.

4. A model railway system as set forth in claim 1 in which the coupler lifting magnetic means is a permanent magnet and is normally maintained far enough below the paths of the coupler carried magnets to be ineffective, but which further includes means for raising said magnetic means to an effective level.

5. A model railway system as set forth in claim 4 in which the side magnets are also permanent magnets, normally rendered ineffective by the interlocked condition of the car couplers so long as the coupler lifting magnet remains in an ineffective condition, but immediately made effective to swing the couplers apart laterally as soon as the coupler lifting magnet is made effective, and remaining effective to do so after the coupler lifting magnet has been permitted to return to its normal, ineffective position.

6. A model railway system as set forth in claim 1 in which the coupler lifting magnet and the side magnets are all electromagnets, energized in a common circuit and rendered effective by the closing of a common switch.

7. A model railroad system as set forth in claim 6 in which the side magnets extend beyond the coupler lifting magnets at both ends of the latter, for assuring establishment and maintenance of the uncoupled relationship with both couplers down and one pushing the other.

8. A model railway system as set forth in claim 6 in which the rails at the uncoupling station are the coupler attracting poles of the side magnets.

* * * * *